United States Patent [19]

Seaborne

[11] Patent Number: 4,965,427

[45] Date of Patent: Oct. 23, 1990

[54] AMPHOTERIC CERAMIC MICROWAVE HEATING SUSCEPTOR COMPOSITIONS WITH METAL SALT MODERATORS

[75] Inventor: Jonathan Seaborne, Corcoran, Minn.

[73] Assignee: General Mills, Inc., Minneapolis, Minn.

[21] Appl. No.: 270,179

[22] Filed: Nov. 14, 1988

Related U.S. Application Data

[62] Division of Ser. No. 94,972, Sep. 10, 1987, Pat. No. 4,808,780.

[51] Int. Cl.[5] ..... H05B 6/80

[52] U.S. Cl. ..... 219/10.55 E; 219/10.55 F; 99/DIG. 14

[58] Field of Search ..... 219/10.55 E, 10.55 F, 219/10.55 M; 99/DIG. 14

[56] References Cited

U.S. PATENT DOCUMENTS

| | | | |
|---|---|---|---|
| 2,582,174 | 1/1952 | Spencer | 99/221 |
| 2,830,162 | 4/1958 | Copson et al. | 219/10.41 |
| 3,585,258 | 6/1971 | Levinson | 264/26 |
| 3,591,751 | 7/1971 | Goltsos | 219/10.55 E |
| 3,705,054 | 12/1972 | Matsushita et al. | 117/124 A |
| 3,783,220 | 1/1974 | Tanizaki | 219/10.55 E |
| 3,853,612 | 10/1974 | Spanoudis | 117/212 |
| 3,857,009 | 12/1974 | MacMaster et al. | 219/10.55 E |
| 3,922,452 | 11/1975 | Forker, Jr. et al. | 428/35 |
| 3,946,187 | 3/1976 | MacMaster et al. | 219/10.55 E |
| 3,946,188 | 3/1976 | Derby | 219/10.55 E |
| 4,003,840 | 1/1977 | Ishino et al. | 252/62 |
| 4,190,757 | 2/1980 | Turpin et al. | 219/10.55 E |
| 4,219,361 | 8/1980 | Sutton et al. | 219/10.41 |
| 4,230,924 | 10/1980 | Brastad et al. | 219/10.55 E |
| 4,266,108 | 5/1981 | Anderson et al. | 219/10.55 E |
| 4,267,420 | 5/1981 | Brastad | 219/10.55 E |
| 4,283,427 | 8/1981 | Winters et al. | 219/10.55 E |
| 4,341,872 | 7/1982 | MacDowell | 501/6 |
| 4,590,349 | 5/1986 | Brown et al. | 219/10.55 E |
| 4,592,914 | 6/1986 | Kuchenbecker | 426/107 |
| 4,594,492 | 6/1986 | Maroszek | 219/10.55 E |
| 4,661,299 | 4/1987 | Thorsrud | 264/25 |
| 4,808,780 | 2/1989 | Seaborne | 219/10.55 E |

OTHER PUBLICATIONS

"Controlled Microwave Heating and Melting of Gels" by Roy et al., J. Am. Ceram. Soc 68(7) 392-95 (1985).

"Microwave Heating of Neptheline Glass Ceramics" by J. MacDowell, Ceramic Bulletin, vol. 63, No. 2 (1984).

*Primary Examiner*—Roy N. Envall, Jr.

*Attorney, Agent, or Firm*—John A. O'Toole

[57] ABSTRACT

Disclosed are improved ceramic compositions which are useful in the formulation of microwave susceptors and to the susceptors fabricated therefrom for disposable packages for the microwave heating of food items. The compositions include certain metal salts as time/-temperature profile moderators in addition to a novel microwave absorbing material and a binder. Certain metal salts can be used to dampen or lower the final temperatures reached upon microwave heating the ceramic compositions. Other metal salts can be used to increase or accelerate the final temperature reached upon microwave heating. The microwave absorbing materials comprise selected ceramics in both their native and amphoteric forms. Such useful ceramics are those with residual lattice charges or an unbalance of charge in the fundamental framework or layers such as vermiculite, bentonite, hectorite, zeolites, selected micas including Glauconite, phlogopite and Biotite and mixtures thereof. These ceramics are activated to their amphoteric form by treatment with either acids or bases. The compositions provide good heat generation and a predeterminable upper temperature limit which is higher in the amphoteric form than in their native form. The ceramic materials are common and inexpensive.

13 Claims, 8 Drawing Sheets

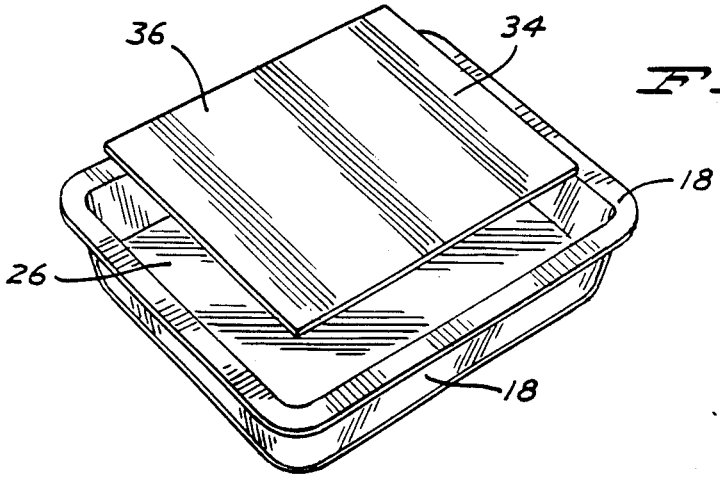
FIG. 4
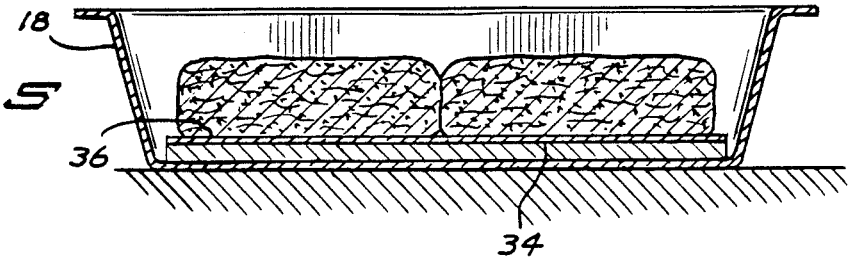
FIG. 5
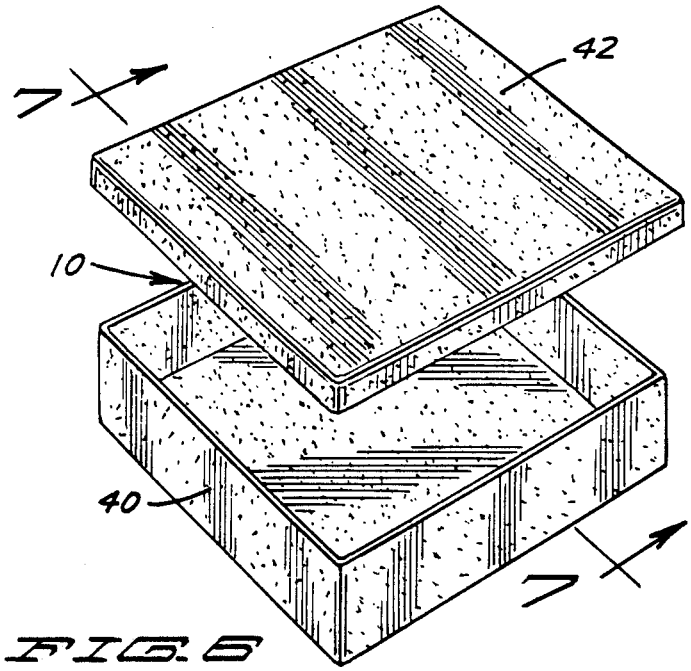
FIG. 6
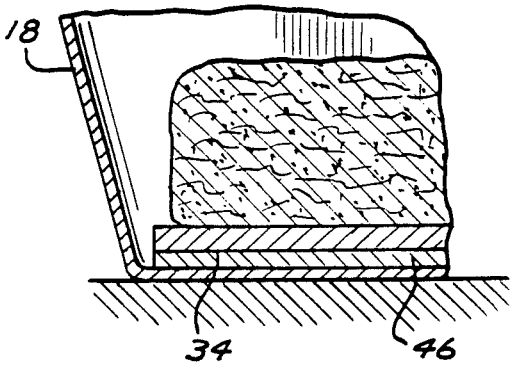
FIG. 5A
FIG. 7
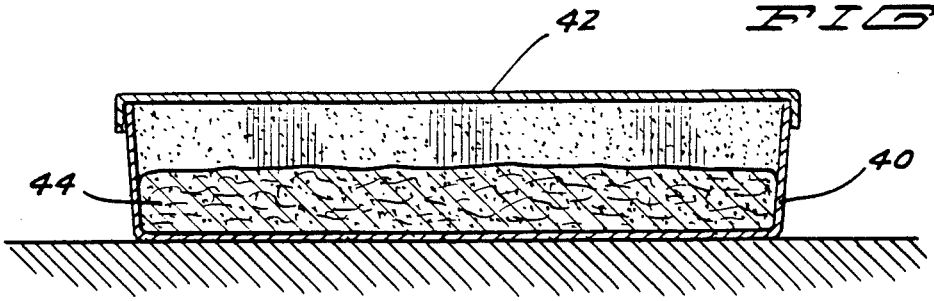

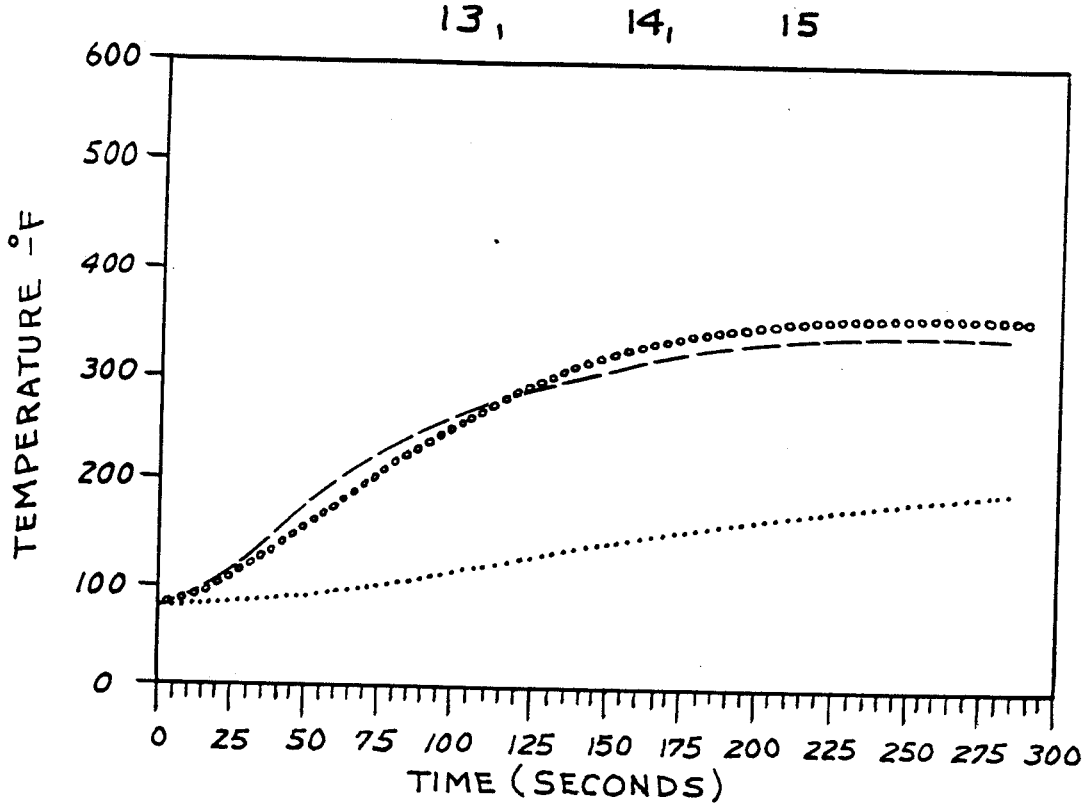
FIG. 12 -13 ·14 ∘15
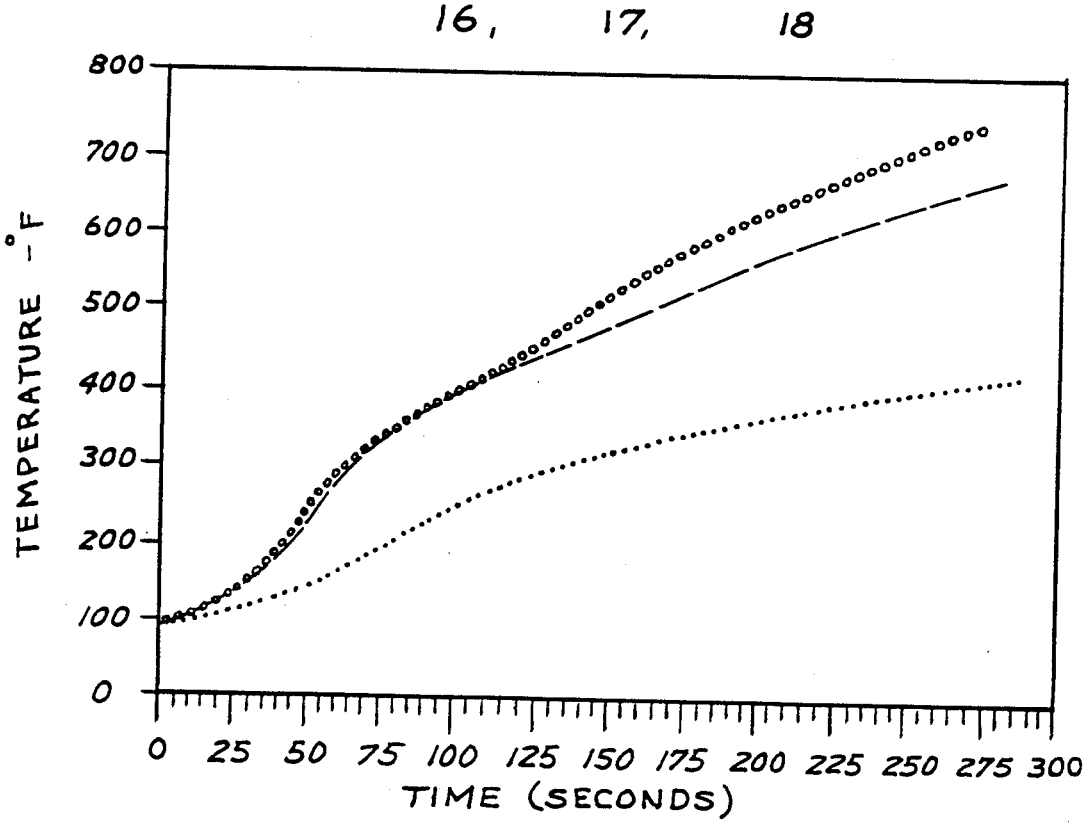
FIG. 13 -16 ·17 ∘18

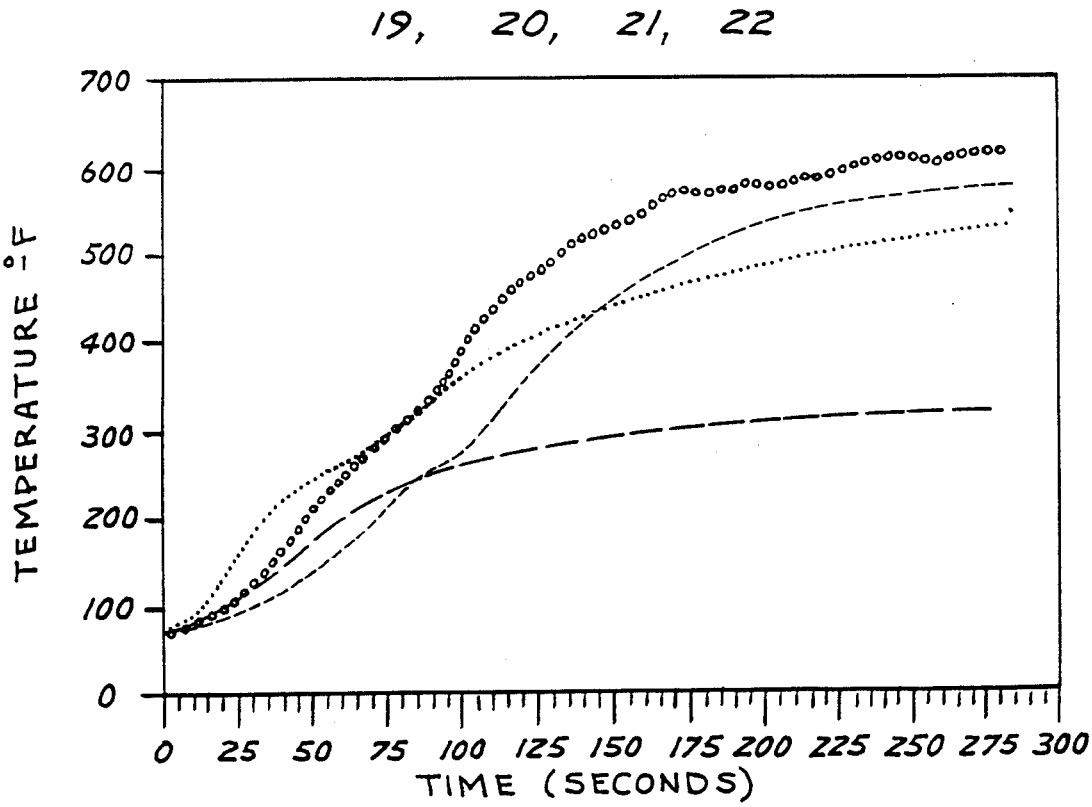
FIG. 14 -19, ·20, ∘21, -22
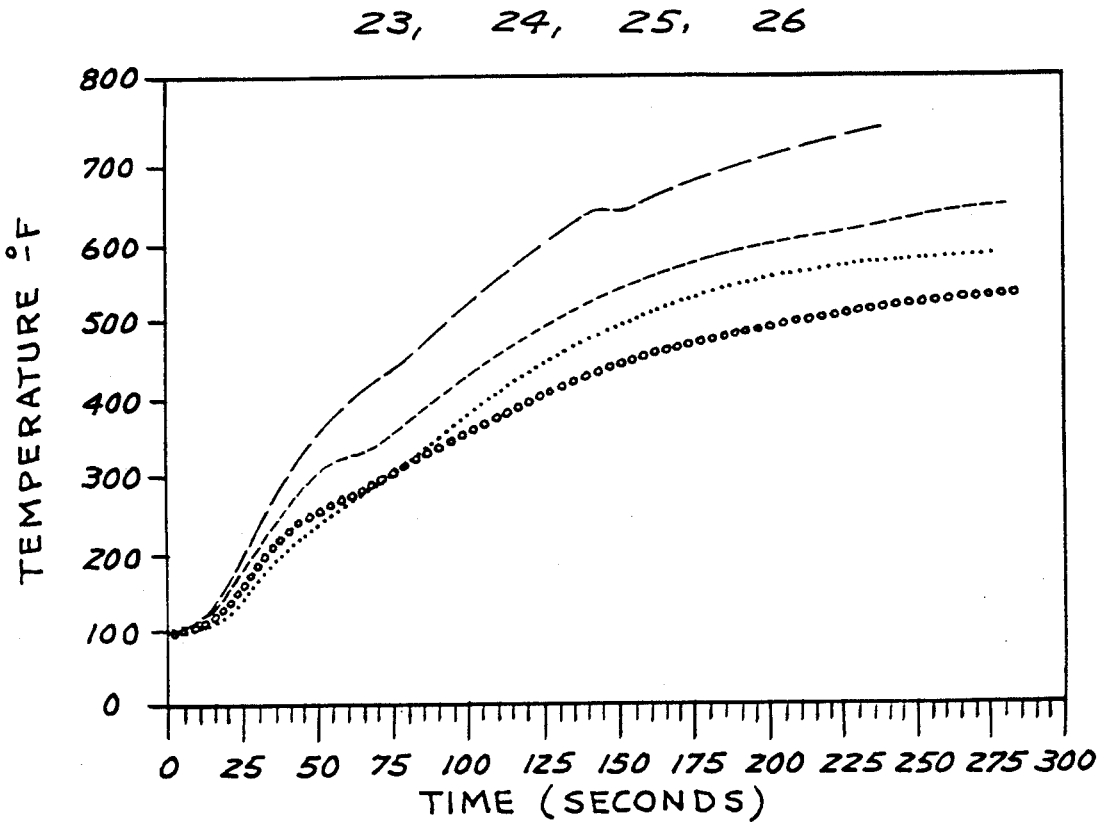
FIG. 15 -23, ·24, ∘25, -26

AMPHOTERIC CERAMIC MICROWAVE HEATING SUSCEPTOR COMPOSITIONS WITH METAL SALT MODERATORS

This is a division of application Ser. No. 094,972, filed 09/10/87, U.S. Pat. No. 4,808,780.

CROSS REFERENCE TO RELATED APPLICATION

This application is an improvement in the invention disclosed in U.S. Ser. No. 066,376, filed June 25, 1987, entitled AMPHOTERIC CERAMIC MICROWAVE HEATING SUSCEPTOR COMPOSITIONS.

BACKGROUND OF THE INVENTION

1. The Technical Field

This invention relates generally to the art of the microwave heating by high frequency electromagnetic radiation or microwave energy. More particularly, the present invention relates to ceramic compositions useful for fabrication into microwave susceptors, and to microwave heating susceptors fabricated therefrom, suitable for disposable microwave packages for food products 2. Background Art The heating of food articles with microwave energy by consumers has now become commonplace. Such microwave heating provides the advantages of speed and convenience. However, heating certain food items, e.g., breaded fish portions with microwaves often gives them a soggy texture and fails to impart the desirable browning flavor and/or crispness of conventionally oven heated products due in part to retention of oil and moisture. Unfortunately, if microwave heating is continued in an attempt to obtain a crisp exterior, the interior is generally overheated or overdone.

The prior art includes many attempts to overcome such disadvantages while attempting to retain the advantages of microwave heating. That is, the prior art includes attempts at providing browning or searing means in addition to microwave heating. Basically, three approaches exist whether employing permanent dishes or disposable packages to providing microwave heating elements which provide such browning or searing and which elements are referred to herein and sometimes in the art as microwave heating susceptors. In the art, materials which are microwave absorptive are referred to as "lossy" while materials which are not are referred to as "non-lossy" or, equivalently, merely "transparent."

The first approach is to include an electrically resistive film usually quite thin, e.g., 0.00001 to 0.00002 cm., applied to the surface of a non-conductor or non-lossy substrate. In the case of a permanent dish, the container is frequently ceramic while for a disposable package the substrate can be a polyester film. Heat is produced because of the $I^2R$ or resistive loss (see, for example, U.S. Pat. Nos. 3,853,612, 3,705,054, 3,922,452 and 3,783,220). Examples of disposable packaging materials include metallized films such as described in U.S. Pat. Nos. 4,594,492, 4,592,914, 4,590,349, 4,267,420 and 4,230,924.

A second category of microwave absorbing materials comprise electric conductors such as parallel rods, cups or strips which function to produce an intense fringing electric field pattern that causes surface heating in an adjacent food. Examples include U.S. Pat. Nos. 2,540,036, 3,271,552, 3,591,751, 3,857,009, 3,946,187 and 3,946,188. Such an approach is usually taken with reusable utensils or dishes.

A third approach is to form articles from a mass or bed of particles that become hot in bulk when exposed to microwave energy. The microwave absorbing substance can be composed of ferrites, carbon particles, etc. Examples of such compositions or articles prepared therefrom include, U.S. Pat. Nos. 2,582,174, 2,830,162 and 4,190,757. These materials can readily experience runaway heating and immediately go to temperatures in excess of 1200° F. Some control over final heating temperature is obtained by lowering of Curie point by addition of dopants or selected binders.

A review of the prior art, especially that art directed towards provision of heating susceptors for disposable packages for microwave heating of foods indicates that at least three basic problems exist in the formulation and fabrication of heating susceptors. One difficulty with the third category of materials, generally, is that they can exhibit runaway heating, that is, upon further microwave heating their temperature continues to increase. Great care must be taken in fabrication of safe articles containing such materials. Metallized film materials of the first category can be formulated and fabricated such that they do not exhibit runaway heating. However, such films suffer from the second problem; namely that while their operating temperatures are quite hot, are at controlled temperatures, and are sufficient to brown the surface of nearby food items, due to their thinness and low mass, only small quantities of heat are actually generated. Such materials are thus unsuitable for certain foods which require absorption of great amounts of heat or "deep heating" in their preparation, e.g., cake batters. The third general problem is one of cost. Microwave susceptors frequently comprise costly materials. Also, fabrication of susceptor structures frequently is complex and expensive.

Accordingly, in view of the above-noted problems with present microwave susceptors, an object of the present invention is to provide materials and devices fabricated therefrom which will heat under the influence of the microwave radiation up to an upper temperature limit at which temperatures the devices come to an equilibrium and cease substantially to absorb additional microwave energy and heating to a higher temperature is precluded.

Another object of the present invention is to provide heating materials for and devices fabricated therefrom which are disposable and adapted for use with preprepared foods.

A still further object of the present invention is to provide heating materials for and devices fabricated therefrom which can be utilized as a non-disposable utensil.

A still further object of the present invention is to provide heating materials for and devices fabricated therefrom which by appropriate selection of manufacturing parameters can provide a predetermined upper temperature limit.

Another object of the present invention is to provide heating materials for and devices fabricated therefrom which are inexpensive to manufacture, safe to use and well adapted for their intended use.

Surprisingly, the above objectives can be realized and new compositions provided which overcome the problems associated with previous materials which have been used for the fabrication of microwave heating susceptors. The present compositions and devices do not exhibit runaway heating yet generate relatively large amounts of heat. Indeed, the final heating temperature can be controlled quite closely. Also, the present compositions are comprised of materials which are commonly available and cheap. In the most surprising aspect of the present invention, the compositions comprise ceramic materials previously considered to be microwave transparent or used in microwave transparent ceramic compositions.

BRIEF DESCRIPTION OF THE DRAWINGS

FIG. 4 is a perspective view of the tray with the food items removed showing a microwave heating susceptor raised above its resting position in the tray;

FIG. 5 is a cross sectional view of the tray taken in the direction of lines 5—5 of FIG. 3;

FIG. 6 is a perspective view of an alternate tray with a lid, each fabricated from the present compositions with food items removed;

FIG. 7 is a perspective view of the alternate tray taken in the direction of lines 7—7 of FIG. 6.

FIGS. 8–18 depict time/temperature response curves for ceramic compositions exemplified in Examples 1–35.

SUMMARY OF THE INVENTION

Figure 1:
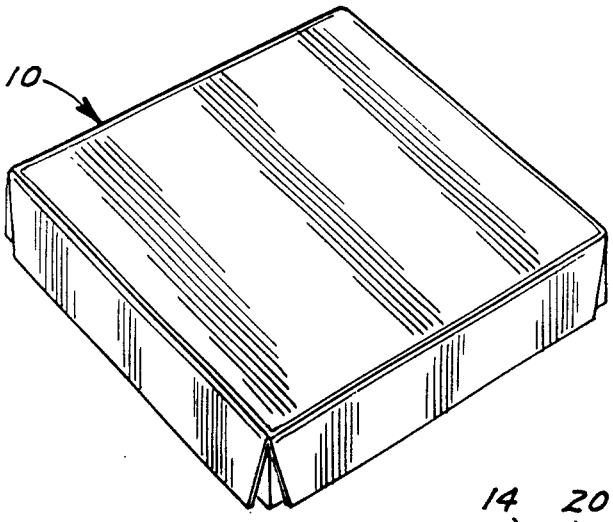
FIG. 1 is a perspective view of a packaged food article for microwave heating constructed in accordance with the teachings of the invention.

The present invention provides improved compositions useful in the formulation and fabrication of microwave heating susceptors. The present, improved compositions comprise in addition to an active microwave absorbing material and a binder as well as a metallic salt moderator.

The present defined microwave absorbing materials are common ceramic ingredients/resources and are essentially characterized by having a residual lattice charge, best defined as having a cation exchange capacity (CEC) or more broadly an ion exchange capacity. The microwave absorbing materials can comprise from about 2% to 99.9%, preferably 20% to 99% of the ceramic compositions. In preferred embodiments, the material is activated to its amphoteric form by treatment with either acids or bases.

The binder essentially comprises about 0.1% to 98%, preferably 1% to 80% of the compositions. Conventional binder materials are suitable for use herein.

In its article aspect, the present invention resides in devices fabricated from the present improved compositions. Such devices include microwave heating susceptors preferably in sheet form and which range in thickness from about 0.3 to 8 mm. In another preferred embodiment, the heating susceptor is in the form of a tray. The susceptors find particular usefulness in, and the present invention resides further in disposable packages for the microwave heating of food.

Throughout the specification and claims, percentages are by weight and temperatures in degrees Fahrenheit, unless otherwise indicated.

DETAILED DESCRIPTION OF THE INVENTION

The present invention relates to compositions useful for fabrication into heating susceptors for disposable packages for the microwave heating of food products. The compositions comprise a defined microwave absorbing material, a binder and certain metal salts as temperature profile modulators. In its article aspect, the present invention provides new and improved microwave heat susceptors for packaged food items, to packages for such items and to the packaged food items themselves. Each of the composition ingredients and susceptor elements are described in detail below.

The present compositions are an improvement in the ceramic compositions described in "Amphoteric Ceramic Microwave Heating Susceptor Compositions" (by J. Seaborne as, U.S. Pat. No. 4,881,831, issued Apr. 4, 1989) and which is incorporated herein by reference. It is also to be appreciated that these amphoteric materials are to be distinguished from those ceramic materials which are non-amphoteric such as are described in my co-pending application entitled "Solid State Ceramic Microwave Heating Susceptor Compositions," U.S. Ser. No. 056,201, U.S. Pat. No. 4,810,845, issued Mar. 7, 1989.

In the ceramic industry, a distinction is made between "greenware," a ceramic composition before firing, and finished, fired ceramic compositions. The firing step profoundly changes a large number of properties of the ceramic composition as the individual constituents are fused into a homogeneous mass. Broadly speaking, the present invention is directed toward compositions which would be considered greenware in the ceramic arts.

Certain of the microwave active materials have been used in greenware ceramic compositions, but generally at markedly different concentrations and for different purposes than in the present invention. For example, ceramic compositions containing minor amounts, e.g., 1–2%, of vermiculite are known However, since vermiculite can expand or even explode during firing, ceramic compositions with high vermiculite levels of the present invention are not known. Micas are not generally added to ceramics in large concentrations since fired ceramics with mica undesirably exhibit weakness Likewise, bentonites are also found in clay bodies but at levels less than 2%, otherwise adverse effects, extended drying, increased plasticity, and increased settling times are encountered.

The microwave absorbing materials useful herein surprisingly include a wide variety of ceramic materials previously regarded as microwave transparent or used in ceramic compositions transparent to microwaves. By ceramic materials are meant substantially non-ferrous materials comprising oxygen attached to non-carbonaceous elements, and primarily to magnesium, calcium, iron, aluminum, silicon and mixtures thereof although the materials may include incidental iron along with other trace materials and elements. The present materials are further essentially characterized by a residual lattice charge or, synonymously for purposes herein, as having a positive cation exchange capacity.

The present selected microwave absorbing materials and their other general physical and chemical properties are well known and described generally, for example, in "An Introduction to the Rock Forming Materials," by Deer, Howie and Zussman, Longman Group Limited, Essex, England., 1966. Materials are as therein described generally classified as ng silicates, chain silicates, sheet silicates, framework silicates and non-silicates The materials useful herein can fall into any of these classifications although not all materials in those classifications are useful herein. Those materials which are useful are those as described above having a positive cation exchange capacity. The materials are further characterized by relatively low electrical resistivity, i.e., about 0.1 to 35 ohm.cm and are thus classifiable as semiconductors in the broad sense of the term. It is speculated herein that these materials have heretofore been unappreciated as being useful as consumer microwave absorbing materials since most investigations of their electromagnetic absorption/-transparency has been done at very different frequencies if at all.

Exemplary specific materials include:

Vermiculite, $(Mg,Ca)_{0.7}$ $(Mg,Fe^{+3},Al)_{6.0}$ $[(Al,Si)_8O_{20}]$ $(OH_4)$. $8H_2O$ including both native and exfoliated (i.e., having been subjected to roasting heat of 1200° F. whereby the vermiculite is expanded by the loss of bound water);

Glauconite, $(K, Na, Ca)_{1.2-2.0}$ $(Fe^{+3},Al,Fe^{+2},Mg)_{4.0}$ $[Si_{7-7.6}Al_{1-0.4}O_{20}](OH)_4.n(H_2O)$;

Bentonites, $(\frac{1}{2}$ $Ca,Na)_{0.7}$ $(Al,Mg,Fe)_4$ $(Si,Al)_8O_{20}](OH_4).nH_2O$;

Montmorillonoids or smectites, $(\frac{1}{2}$ $Ca,Na)_{0.7}$ $(Al,Mg,Fe)_4[(Si,Al)_8O_{20}](OH)_4.nH_2O$; phlogopite mica, $K_2(Mg,Fe^{+2})_6[Si_6Al_2O_{20}](OH,F)_4$; Biotite mica, $K_2(Mg,Fe^{+2})_{6-4}(Fe^{+3},Al,Ti)_{0-2}$ $[Si_{6-5}Al_{2-3}O_{20}](OH,F)_4$;

Zeolite, whether natural or synthetic: general formula, $M_xD_y[Al_{x+2y}Si_{n-(x+2y)}O_{2n}].mH_2O$ where M=Na,Ka, or other monovalent cations D=Mg,Ca,Sr,Ba, and other divalent cations;

Hectorites, $(\frac{1}{2}$ Ca, $Na)_{0.66}$ $(Si_8Mg_{5.34}Li_{0.66}O_{20})$ $(OH)_n.nH_2O$;

Chlorites, $(Mg, Al, Fe)_{12}$ $[(Si,Al)_8O_{20}](OH)_{16}$;

Illites, $K_{1-1.5}$ $Al_4$ $[Si_{7-6.5}Al_{1-1.5}O_{20}](OH)_4$;

Attapulgites;

Saponite $(\frac{1}{2}$ Ca, $Na)_{0.66}$ $[Si_{7.34}Al_{0.66}Mg_6O_{20}](OH)_n.nH_2O$;

Sepiolite.,

Ferruginous smectite $(\frac{1}{2}$ Ca, $Na)_{0.66}$ $(Al,Mg,Fe)_4$ $[(Si,Al)_8O_{20}](OH)_4.nH_2O$;

Kaolinites; and

Halloysite.

Other materials with residual lattice charges or cationic exchange capacity, e.g., mixed layer clays and the like and mixtures thereof can also be used. Preferred materials include vermiculite, bentonite, hectorite, saponite, smectites, glauconites, micas and illite and mixtures thereof due to the relatively flat and/or uniformity of their final heating temperature.

Surprisingly, these materials will experience heating activity when exposed to consumer microwave energy frequency (2450 MHz) in their native form. However, it has been even more surprisingly discovered that this native microwave absorption activity can be greatly increased by treatment of these materials to either acid or base treatment. The resulting acid or base activated or "charged" materials are collectively referred to as "amphoteric materials," i.e., materials which are reactive to both acids and bases or, equivalently, materials in their "amphoteric" form as opposed to their native form.

The present amphoteric materials can be obtained by treating the materials in an excess of aqueous solutions, e.g., of acids ranging from mild to strong pH of 6.0 to 1.0. Useful acids include all manner of mineral or organic acids including Lewis acids. Useful acids, for example, include hydrochloric, nitric, phosphoric, sulfuric acid, citric, acetic, boric and aluminum chloride. Also useful herein to achieve a basic amphoteric form is to treat the materials with mild solutions, e.g., pH of 7 to 11, of strong bases or Lewis bases, e.g., sodium hydroxide, sodium carbonate, sodium bicarbonate, potassium bicarbonate, hydroxide, urea, triethanolamine, ammonium hydroxide, sodium sulfide, sodium metaborate, sodium sulfate and sodium or potassium citrate. Due to the density and surface area of these materials, treatment can be readily accomplished by simple steeping in sufficient amounts of solution to cover the materials. The duration of the step is not critical and good results can be obtained from as little as one minute of treatment although a somewhat longer treatment is preferred.

While not wishing to be bound by the proposed theory, it is speculated herein that the pH treatment causes ion implantation to the backbone or lattice framework of the mineral thereby changing or modifying the lattice charges and the ionic character or ratio of the treated materials.

The present compositions include an effective amount of the above-described microwave absorbing materials. The precise level will depend on a variety of factors including end use application, active material(s) selected, amount and type of acid or base to charge the materials, desired final temperature, and thickness of the susceptor device. Good results are generally obtained when the microwave absorbing material comprises from as little as about 2% to about 99.9% by weight of the present ceramic compositions. Preferred compounds include from about 15% to 99% by weight of the microwave absorbing material. For better results, the ceramic compositions comprise about 20% to 99%, and for best results about 40% to 99% by weight of the microwave absorbing materials. The particle size of the microwave absorption material or refractory is not critical. However, finely ground materials (i.e., having an average particle size of less than 200 microns) are preferred inasmuch as the ceramic susceptors produced therefrom are smooth and uniform in texture.

Another essential component of the present ceramic compositions is a conventional ceramic binder. Such ceramic binders are well known in the ceramic art and the skilled artisan will have no problem selecting suitable binder materials for use herein. The function of the binder is to form the particulate microwave absorbing material into a solid form or mass. Exemplary materials include both ceramic and plastic binder materials, including, for example, cement, plaster of Paris, i.e., calcium sulphate, silica fiber, silica flour, selected micas, (non-microwave active) selected talcs, colloidal silica, lignin sulphonate, Kelvar®, ethyl silicate, fibrous calcined Kaolin, calcium carbonate, dolomite, feldspar, pyrophyllite, nepheline, flint flour, mullite, selected clays, silicone, epoxy, crystallized polyester, polyimide, polyethersulfones, wood pulp, cotton fibers, polyester fibers and mixtures thereof The binder can comprise from about 0.1% to 99.9% by weight of the present ceramic compounds, preferably from about 1% to 85%, and for best results about 1% to 60%. Additional exemplary, conventional plastic based binders, both thermoplastic and thermosetting, are described in U.S. Pat. No.

4,003,840 (issued Jan. 19, 1977 to Ishino et al.) which is incorporated herein by reference.

In one preferred embodiment, the present compositions include binders which are organic thermoplastic resins especially those approved as food packaging material such as polyvinyl chloride, polyethylene, polyamides, perfluorocarbon resins, polyphenylene sulfones, polysulfones, polyetherimides, polyesters, polycarbonates, polyimides, epoxies, etc. In these embodiments, the thermoplastic resin binders can range from as little as 5% up to 60% of the composition and preferably about 15% to 50%. Such compositions are especially well suited for fabrication into shaped microwave susceptors, especially food trays, e.g., for TV dinners or entrees.

In certain preferred embodiments, the ceramic compositions additionally essentially include reinforcing fibers or fabric reinforcing. The fibers provide additional strength and resistance from crumbling and breakage. Suitable fibers (natural or synthetic) (whether plate-like or rods) are characterized by possessing high aspect ratios (the ratio of the fibers width to its length) and in the case of fabric reinforcing are either nonwoven, woven or of the cord variety. The fibers or fabric reinforcing essentially comprise from about 0.5% to 20%, preferably about 1.0% to 5% of the ceramic compositions.

The present invention resides in the improvements in microwave heating performance realized when the ceramic compositions as are described in my U.S. Pat. No. 4,818,831 referenced above additionally essentially comprise a temperature profile modulator.

In the above referenced patent application, U.S. Pat. No. 4,818,831, it is taught that common salt, sodium chloride, can beneficially be added to certain amphoteric ceramic compositions for increases in heating performance. The present invention resides in part in the discovery that broad classes of other salts can be used in full or partial substitution for common salt. Also, addition of these or other materials can be added to modify the heating time/temperature profile of these ceramic compositions. The addition of these materials herein functionally referred to generally as "modulator(s)" allow for greater control with respect to performance. Three subclasses of temperature moderators have surprisingly been found to exist: (1) dampeners, (2) accelerators or enhancers, and (3) super accelerators. Accelerators, for example, may increase the temperature rate of increase with time when exposed to microwave heating. Accelerators may also increase the maximum obtainable temperature. Dampeners have the opposite effect while super accelerators exhibit a markedly greater acceleration effect.

Exemplary useful dampeners are selected from the group consisting of MgO, CaO, $B_2O_3$, Group 1A alkali metal (Li, Na, K, Cs, etc.) compounds of chlorates ($LiClO_3$, etc.), metaborates ($LiBO_2$, etc.) bromides (LiBr, etc.) benzoates ($LiCO_2C_6H_5$, etc.), dichromates ($Li_2Cr_2O_7$, etc.), also; all calcium salts, $SbCl_3$, $NH_4Cl$, $CuCl_2$, $CuSo_4$, $MgCl_2$, $ZnSO_4$, Sn(II) chloride, Vanadyl sulfate, chromium chloride, cesium chloride, cobalt chloride, Nickel ammonium chloride, $TiO_2$ (rutile and anatase), and mixtures thereof. Exemplary useful accelerators are selected from the group consisting of Group 1A alkali metal (Li, Na, K, Cs, etc.) compounds of chlorides (LiCl, etc.), nitrites ($LiNO_2$, etc), nitrates ($LiNO_3$, etc.), iodides (LiI, etc.), bromates ($LiBrO_3$, etc.), fluorides (LiF, etc.), carbonates ($Li_2CO_3$, etc.), phosphates ($Li_3PO_4$, etc.), sulfites ($Li_2SO_3$, etc.), sulfides (LiS, etc.), hypophosphites ($LiH_2PO_2$, etc.), also $BaCl_2$, $FeCl_3$, sodium borate, magnesium sulfate, $SrCl_2$, $NH_4OH$, Sn(IV) chloride, silver nitrate, TiO, $Ti_2O_3$, silver citrate and mixtures thereof. Super accelerators are desirably selected from the group consisting of $B_4C$, $ReO_3$ CuCl, ferrous ammonium sulfate, $AgNO_3$, Group 1A alkali metal (Li, Na, K, Cs, etc.) compounds of hydroxides (LiOH, etc.), hypochlorites (LiOCl, etc.), hypophosphates ($Li_2H_2P_2O_6$, $Na_4P_2O_6$, etc.), bicarbonates ($LiHCO_3$, etc.), acetates ($LiC_2H_3O_2$, etc.), oxalates ($Li_2C_2O_4$, etc.), citrates ($Li_3C_6H_5O_7$, etc.), chromates ($Li_2CrO_4$, etc.), and sulfates ($Li_2SO_4$, etc.), and mixtures thereof.

Exemplary useful herein as accelerators are certain highly ionic metal salts of sodium, magnesium, silver, barium, potassium, copper, and titanium including, for example, NaCl, $NaSO_4$, $AgNO_3$, $NaHCO_3$, $KHCO_3$, $MgSO_4$, sodium citrate, potassium acetate, $BaCl_2$, KI, $KBrO_3$, and CuCl. The most preferred accelerator useful herein is common salt due to its low cost and availability.

The temperature profile accelerator(s) can assist in reaching more quickly the final operating temperature of the ceramic composition. Also, the accelerator(s) increases modestly the final operating temperature of the ceramic composition. The expected effect of the heating profile accelerator when added to the unactivated or natural form of the present active ingredient is, generally speaking, merely additive. Surprisingly, however, the effect upon the present active ingredients with respect to heating temperature is highly synergistic. Again, while not wishing to be bound by the proposed theory, it is speculated herein that the increased microwave activity may be due to selected salts or their constituent ions being grafted to backbone active sites.

The preferred ceramic compositions comprise from about 0.001% to about 10% by weight metal salt. Preferably, the present compounds comprise from about 0.1% to 6% of the moderator. For best results about 0.5% to 6% moderator is used.

While ceramic compositions can be formulated having higher amounts of these metal salts, no advantage is derived therefrom. It is also believed important that the temperature profile moderators exist in an ionized form in order to be functional. Thus, ceramic compositions beneficially containing these salts should contain some moisture at some point in the composition preparation.

The present ceramic compositions can be fabricated into useful articles by common ceramic fabrication techniques by a simple admixture of the materials into a homogeneous blend, and for those binders requiring water, e.g., cement or calcium sulphate addition of sufficient amounts of water to hydrate the binder. Typically, water will be added in a weight ratio to composition ranging from about 0.07 to 1:1. While the wet mixture is still soft, the ceramic compositions can be fabricated into desirable shapes, sizes and thicknesses and thereafter allowed to harden. The materials may be dried at accelerated rates without regard to drying temperatures and can be dried with air temperatures even in excess of 180° F. but less than fusion or firing temperatures (<1000° F.).

Another common fabrication technique is referred to as compression molding. In compression molding a damp mix, e.g., 3–10% moisture of water activated binders, are employed, or a dry mix if not, is placed into a mold and subjected to compression to effect a densification of the composition to form a firm body. Still another useful fabrication technique is isostatic pressing which is similar to compression molding but with one side of the mold being flexible. Isostatic pressing is especially useful in forming curved ceramic pieces.

The final heating temperature of the present compositions is mildly influenced by the thickness of the susceptor elements fabricated. Good results are obtained when susceptor thickness ranges from about 0.3 to 8 mm in thickness, both when using the present improved compositions and when using the previously described ceramic compositions without the temperature profile moderators. Preferred susceptors have thicknesses ranging from 0.7 to 4 mm. All manner of shapes and size heating susceptors can be fabricated although thin flat tiles are preferred in some applications.

Still another advantage of the present invention is that susceptors fabricated from the present ceramic compositions provide a microwave field modulating effect, i.e., evening out peaks and nodes, i.e., standing wave points and, it is believed independent of wattage. This benefit is especially useful when sensitive foods such as cookie doughs or protein systems are being microwave heated Still another advantage of the present ceramic compositions is that they are believed to be useful not only with microwave ovens operating at 2450 MHz but at all microwave frequencies, i.e., above as low as 300 MHz.

Another advantage is that the ceramic susceptor can be coated with plastics or inorganic coatings to render the surface non-absorptive to moisture and oil as well as providing a non-stick surface. Also; colorants, both organic and inorganic in nature may be incorporated at appropriate levels into either the coating or body of the ceramic susceptor to aid in aesthetics without adversely affecting the performance of the ceramic susceptor.

It is important that the susceptors fabricated herein be unvitrified, i.e., not subjected to a conventional firing operation generally above 800° F. to 1000° F. (426° C. to 538° C.). Conventional firing can result in a fused ceramic composition substantially transparent to microwave and thus devoid of the desirable microwave reactive properties of the present invention The present ceramic compositions are useful in any number of microwave absorption applications. The present ceramic compositions are particularly useful for fabrication into microwave susceptors which in turn are useful as components in packages for foods to be heated with microwaves.

Figure 2:
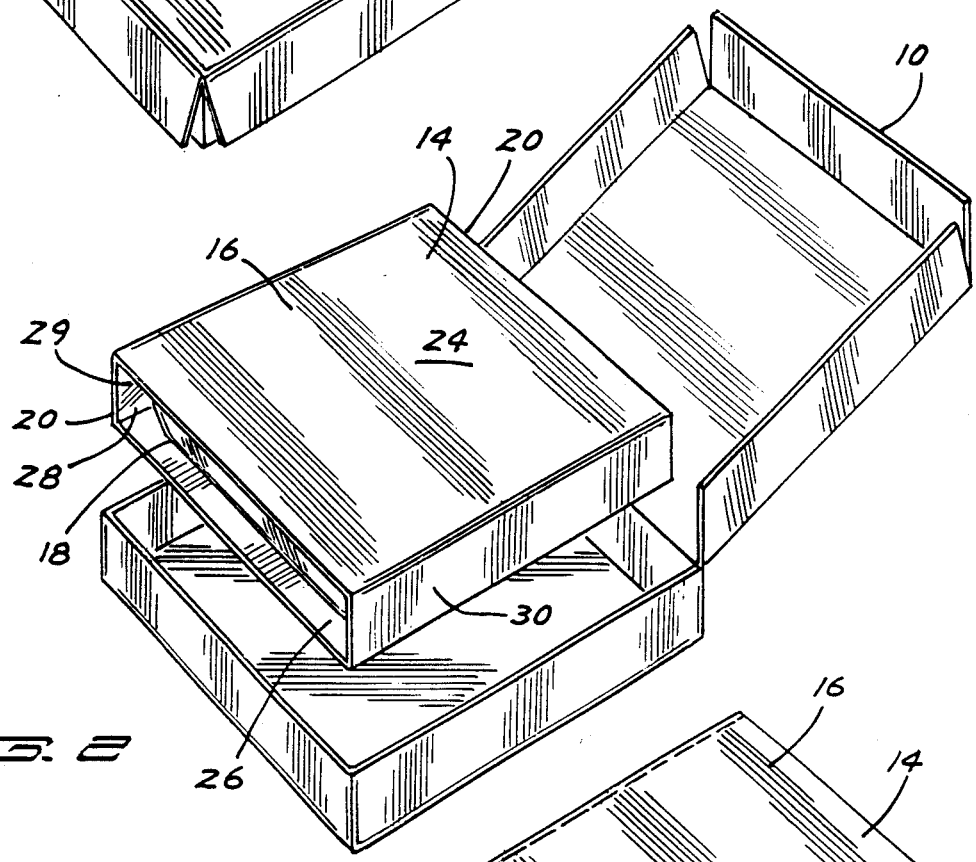
FIG. 2 is a perspective view of the packaged food article with outer paperboard outerwrap opened and with an inner tray and sleeve shown disengaged.

For example, FIG. 1 illustrates generally a packaged food item 10 fabricated in accordance with the teachings of the present invention and suitable for microwave heating. FIG. 2 shows that the article 10 can optionally comprise a six-sided outerwrap 12 which can be plastic, e.g., shrink wrap, paper or other conventional packaging material such as the paperboard package depicted The article can further comprise an inner assembly 14 disposed within the outerwrap 12 which can comprise a sleeve 16 fabricated from a dielectric material and disposed therein a tray 18. In conventional use, the consumer will open the article 10, remove and discard the overwrap 12, and insert the entire assembly into the microwave oven The sleeve 16 is helpful although not essential not only to prevent splattering in the microwave oven, but also to assist in securing the food items against excessive movement during distribution.

Figure 3:
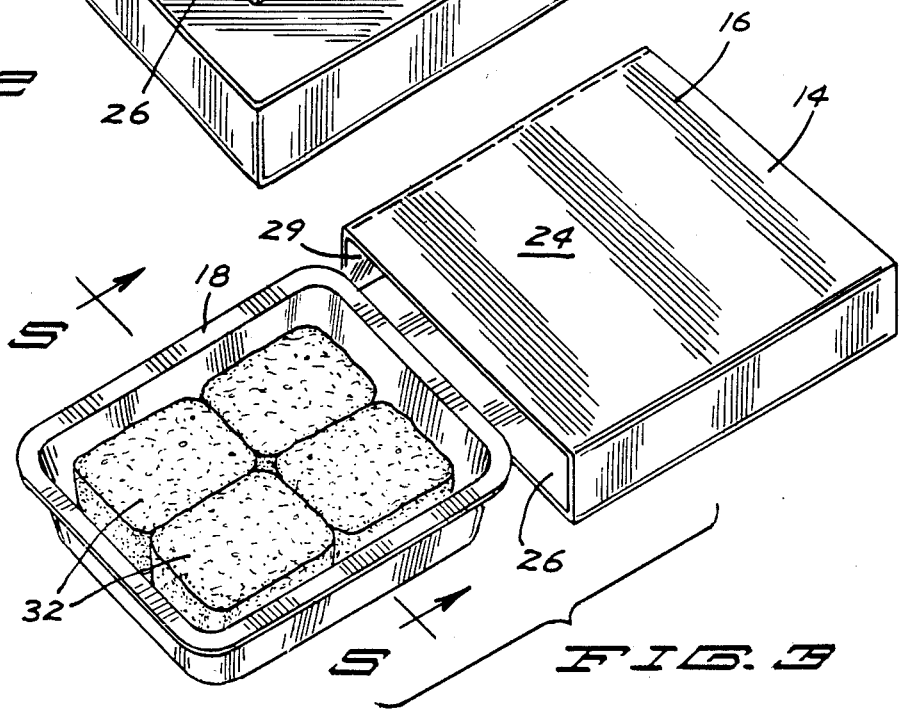
FIG. 3 is a perspective view of the tray disengaged from the sleeve and holding several food pieces.

In FIG. 2, it can be seen that the sleeve 16 can comprise an opposed pair of open ends, 20 and 22, an upper major surface or top wall 24, a lower major surface or bottom wall 26 and an opposed pair of minor side or wall surfaces 28 and 30. As can be seen in FIG. 3, the tray 18 holds or contains one or more food items 32. FIG. 4 shows the tray 18 with the food items 32 removed Disposed within the tray 18 is one or more microwave heating susceptors such as microwave susceptor heating panel 34. In this preferred embodiment, the susceptors are generally flat or planar and range in thickness from 0.020 to 0.250 inch.

Still referring to FIGS. 3 and 4, with the cooking of certain foods, it may be desirable to heat the food items 32 from only or primarily one side by use of the heating susceptor panel 34 while at the same time minimizing the heating of food item 32 by exposing it to microwave radiation through the walls of the package assembly 14. To allow microwave radiation to reach the susceptor 34, the bottom wall 26 is microwave transparent at least to the extent that sufficient microwave energy can enter the package to heat the susceptor 34. Side walls 28 and 30 can each optionally be shielded with shielding 29 as can top wall 24 thereby restricting the entry of microwave radiation through these walls to the food product as is known in the art. The shielding 29 can be of any suitable type material of which aluminum foil is a currently preferred material. With the use of shielding, the microwave radiation penetrates the microwave transparent bottom 26 only. Accordingly, cooking of the food product 32 in this embodiment is accomplished substantially totally by the heat transferred to the food product 32 from the susceptor 34 although some microwave entry through the open ends 20 and 22 occurs. It is pointed out that the terms microwave transparent and microwave shield are relative terms as used herein and in the appended claims.

In FIG. 5, it can be seen that the heating panel 34 can optionally comprise a thin finish layer 36, e.g., 0.00005 to 0.001 inch (0.001 to 0.025 mm) to impart desirable surface properties, e.g., color, water repellency, smooth appearance, stick free, etc. In the simplest form, such a layer can comprise ordinary paraffin or a sodium silicate polymerized with zinc oxide. The finish layer does not substantially adversely affect the performance of the microwave susceptor. Such surface property modification finds particular usefulness when the microwave susceptors are used in medical settings. For example, it is known to fabricates surgical implants, e.g., discs, cylinders, from ferrites which absorb microwave radiation to thermally treat tumors. In such applications wherein the present compositions are employed, water repellency may be particularly desirable.

Other types of packages can be utilized with the ceramic microwave heater compositions of the present invention. It is an important advantage that the present compositions can be fabricated into susceptors of different configurations whether regular, e.g., corrugated, or irregular.

Another embodiment is depicted in FIG. 6. Thermoplastic resins are preferred for use as the binder materials. In this embodiment, the article 10 in addition to outerwrap 12 as shown in FIG. 2 can comprise a microwave heating susceptor 40 fabricated into trays or shallow pans whether square, rectangular, circular, oval, etc. which serve both to contain and heat the food items. Such tray shaped susceptors 40 find particular suitability for use in connection with a batter type food item 44, especially cake batters or with casseroles, baked beans, scalloped potatoes, etc. In one particular embodiment the tray 40 can additionally include a cover 42 also fabricated from the present ceramic compositions. Trays 40 with covers 42 are especially useful for batter food items like brownies in which it is desired to form an upper or top skin to the food item 44.

In still another embodiment shown in FIG. 5A, the panel susceptor 34 can additionally comprise a backing layer(s), especially a metal foil, e.g., aluminum 46. The foil serves to reflect back to the susceptor 34 microwave energy passing through the susceptor 34. The incorporation of a microwave shielding or reflecting layer 29 in close proximity on the opposite surface of the ceramic susceptor 34 also serves to act as a susceptor temperature booster to elevate the operating temperature substantially above the temperature obtained without a microwave shielding or reflective layer 29. Final temperature reached can be as high as 100° F. or more over similar structures without the metal foil. Also, the use of the temperature booster can reduce the need for a thicker ceramic susceptor to obtain the same temperature thereby reducing both production costs as well as final weights of the microwave package. Since the ceramic compositions adhere to the metal foil with some difficulty, and cause an in heating interference due to conductor-wave phenomena interaction, it is preferable to treat the surface of the metal foil with an intermediate or primer layer (not shown) for better adherency, i.e., ordinary primer paints, or to have an intermediate silicone layer, or to select those binders for the ceramic compositions with increased capacity to adhere to metal foils.

The skilled artisan will also appreciate that the present compositions absorb microwave radiation at a wide range of frequencies and not merely at those licensed frequencies for consumer microwave ovens.

Upon heating in a conventional microwave oven, e.g., 2450 MHz, the ceramic compositions will relatively quickly (e.g., within 30 to 300 seconds) heat to a final temperature ranging from about 300° to 800° F. which temperature range is very desirable in providing crisping, browning to foods adjacent thereto and consistent with safe operation of the microwave oven. Both the final operating temperature as well as the rapidity to which it is reached is dependent upon whether the material is in its amphoteric state and the degree thereof. Another advantage is that the heating temperature profile with respect to time is relatively flat once an equilibrium state is obtained.

The susceptor compounds of the present invention can also be utilized in non-disposable utensils adapted for repetitive heating cycles by embedding the heater or otherwise associating the heater with a non-disposable utensil body. The susceptor is associated with the remainder of the utensil in a manner such that the heater will be in heat transfer relation to a product to be heated in or on the utensil The utensil can be in the form of an open top dish, griddle or the like. However, the present compositions will exhaust their ability to heat upon microwave exposure relatively quickly, i.e., after only a few cycles of operation.

Still another advantage of the present ceramic susceptor compositions is that they can be fabricated into heating elements which can absorb oil. Such a feature is particularly useful when used to package and to microwave heat food items which are par-fried. A further unexpected advantage is that such oil absorption has minimal adverse effect on heating performance in terms of final heating temperatures reached or heat generation.

Without further elaboration, it is believed that one skilled in the art can, using the preceding description utilize the present invention to its fullest extent. The following preferred specific embodiments are, therefore, to be construed as merely illustrative and not limitative of the remainder of the disclosure whatsoever. It will be appreciated that other modifications of the present invention, within the skill of those in the food, ceramic and packaging arts, can be undertaken without departing from the spirit and scope of this invention.

EXAMPLE 1

Figure 8:
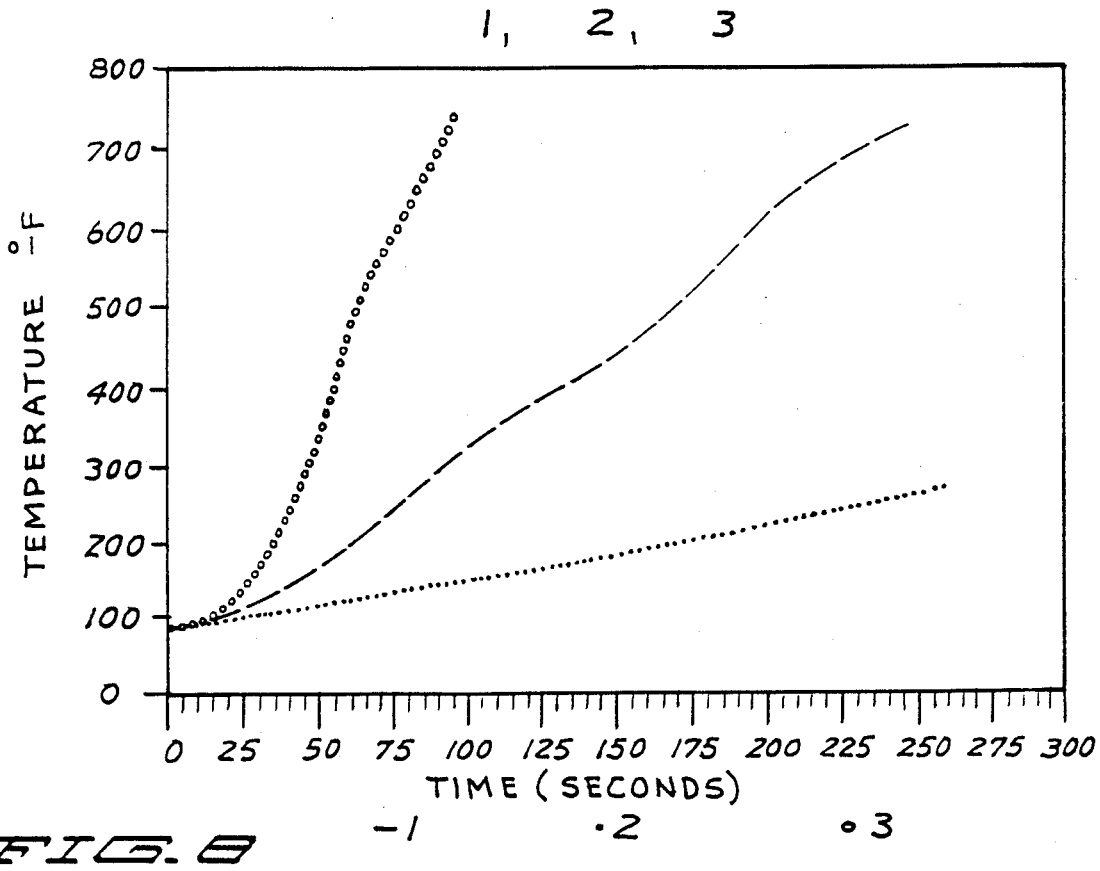

100 grams of crude vermicilite micron grade (available from Strong-Lite Products, Pine Bluff, AR) was treated by soaking in 200 ml of a 0.36N barium chloride (pH 5.3, M.W. 244.28) solution. The crude vermiculite was removed after 3 hours, washed to a neutral pH, filtered and dried at 100° F. (38° C.). 30 grams of the treated crude vermiculite was then placed in a 150 ml beaker without compaction and microwaved in a 750 watt Amana Radarange microwave oven operating at 2460 MHz. During the microwave exposure of the treated crude vermiculite the temperature of the vermiculite was recorded using a Luxtron 750 ® Fluoroptic temperature monitor equipped with ceramic clad fiber optic temperature probes and interfaced with an IBM PC/AT computer for real time data collection and analysis. The recorded and averaged temperature profile of the barium chloride treated vermiculite during the five minute microwave exposure is shown in FIG. 8 as line 1.

EXAMPLE 2

100 grams of crude vermiculite micron grade (available from Strong-Lite Products, Pine Bluff, AR) was treated by soaking in 200 ml of a 0.36N magnesium chloride (pH 9.3, M.W. 203.31) solution. The crude vermiculite was removed after 3 hours, washed to a neutral pH, filtered and dried at 100° F. (38° C.). 30 grams of the treated crude vermiculite was then placed in a 150 ml beaker without compaction and treated as previously described. The recorded and averaged temperature profile during the five minute microwave exposure is shown in FIG. 8 as line 2.

EXAMPLE 3

100 grams of crude vermiculite micron grade (available from Strong-Lite Products, Pine Bluff, AR) was treated by soaking in 200 ml of a 0.36N sodium sulfate (pH 7.1, M.W. 142.04) solution. The crude vermiculite was removed after 3 hours, washed to a neutral pH, filtered and dried at 100° F. (38° C.). 30 grams of the treated crude vermiculite was then placed in a 150 ml beaker without compaction and treated as previously described. The recorded and averaged temperature profile during the five minute microwave exposure is shown in FIG. 8 as line 3.

EXAMPLE 4

Figure 9:
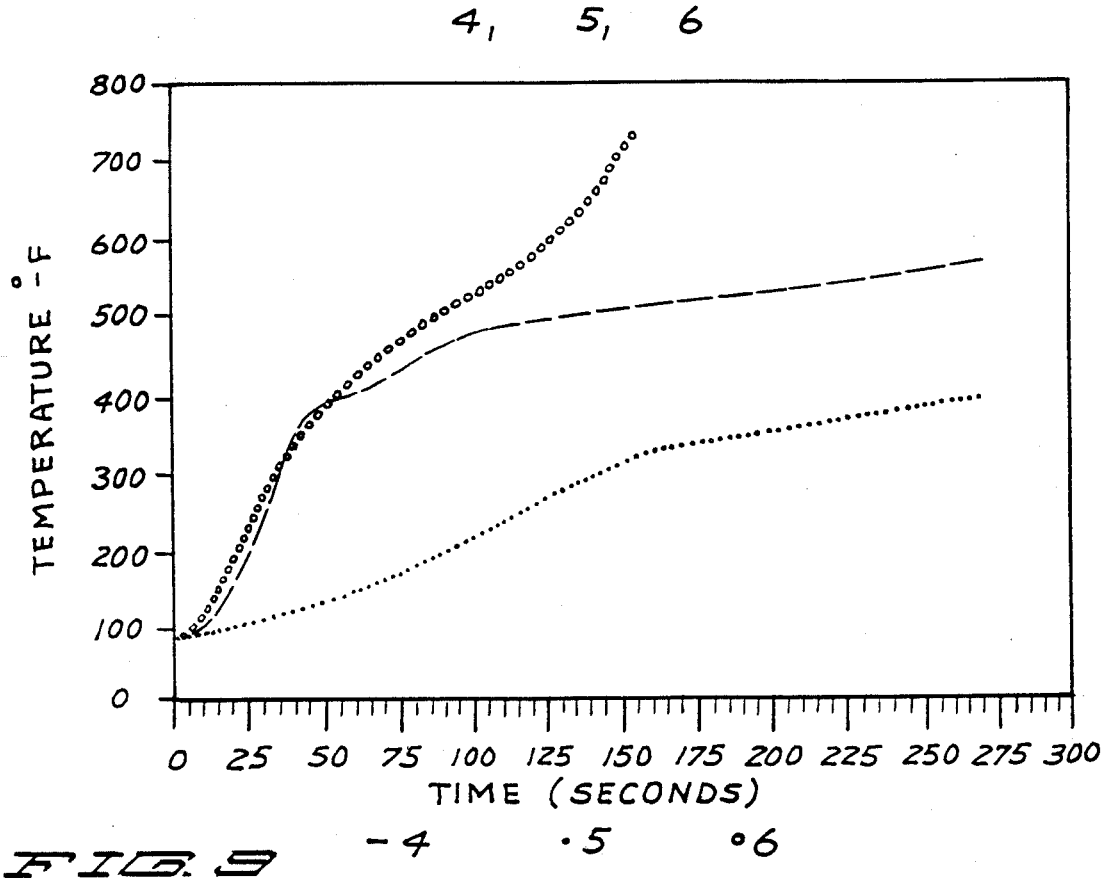

100 grams of western bentonite-SPV200 (available from American Colloid Company, Skokie, Ill.) was treated by soaking in 200 ml of a 0.36N lithium chloride (pH 6.1, M.W. 42.39) solution. The bentonite was removed after 2 hours, washed to a neutral pH, filtered and dried at 100° F. (38° C.). 30 grams of the treated bentonite was then placed in a 150 ml beaker without compaction and treated as previously described. The recorded and averaged temperature profile during the five minute microwave exposure is shown in FIG. 9 as line 4.

EXAMPLE 5

100 grams of western bentonite-SPV200 (available from American Colloid Company, Skokie, Ill.) was treated by soaking in 200 ml of a 0.36N zinc sulfate (pH 4.7, M.W. 287.50) solution. The bentonite was removed after 2 hours, washed to a neutral pH, filtered and dried at 100° F. (38° C.). 30 grams of the treated western bentonite was then placed in a 150 ml beaker without compaction and treated as previously described. The recorded and averaged temperature profile during the five minute microwave exposure is shown in FIG. 9 as line 5.

EXAMPLE 6

100 grams of western bentonite-SPV200 (available from American Colloid Company, Skokie, Ill.) was treated by soaking in 200 ml of a 0.36N sodium citrate (pH 8.7, M.W. 294.10) solution. The bentonite was removed after 2 hours, washed to a neutral pH, filtered and dried at 100° F. (38° C.). 30 grams of the treated bentonite was then placed in a 150 ml beaker without compaction and treated as previously described. The recorded and averaged temperature profile during the five minute microwave exposure is shown in FIG. 9 as line 6.

EXAMPLE 7

Figure 10:
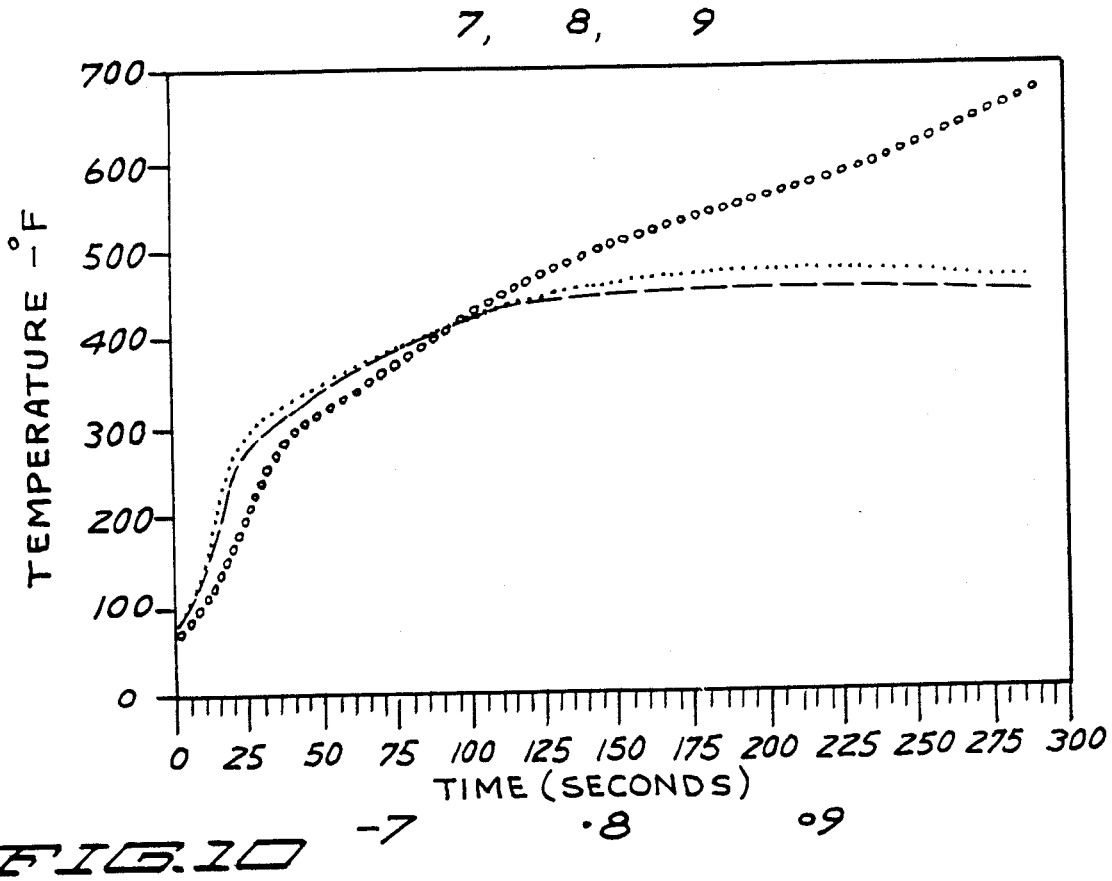

100 grams of hectorite-Hectalite 200 (available from American Colloid Company, Skokie, Ill.) was treated by steeping in 200 ml of a 0.36N sodium fluoride (pH 7.56, M.W. 41.99) solution. The hectorite was removed after 2 hours, washed to a neutral pH, filtered and dried at 100° F. (38° C.). 30 grams of the treated hectorite was then placed in a 150 ml beaker without compaction and treated as previously described. The recorded and averaged temperature profile during the five minute microwave exposure is shown in FIG. 10 as line 7.

EXAMPLE 8

100 grams of hectorite-Hectalite 200 (available from American Colloid Company, Skokie, Ill.) was treated by steeping in 200 ml of a 0.36N calcium chloride (pH 8.6, M.W. 147.02) solution. The hectorite was removed after 2 hours, washed to a neutral pH, filtered and dried at 100° F. (38° C.). 30 grams of the treated hectorite was then placed in a 150 ml beaker without compaction and treated as previously described. The recorded and averaged temperature profile during the five minute microwave exposure is shown in FIG. 10 as line 8.

EXAMPLE 9

100 grams of hectorite-Hectalite 200 (available from American Colloid Company, Skokie, Ill.) was treated by steeping in 200 ml of a 0.36N silver nitrate (pH 7.09, M.W. 169.87) solution. The hectorite was removed after 2 hours, washed to a neutral pH, filtered and dried at 100° F. (38° C.). 30 grams of the treated hectorite was then placed in a 150 ml beaker without compaction and treated as previously described. The recorded and averaged temperature profile during the five minute microwave exposure is shown in FIG. 10 as line 9.

EXAMPLE 10

Figure 11:
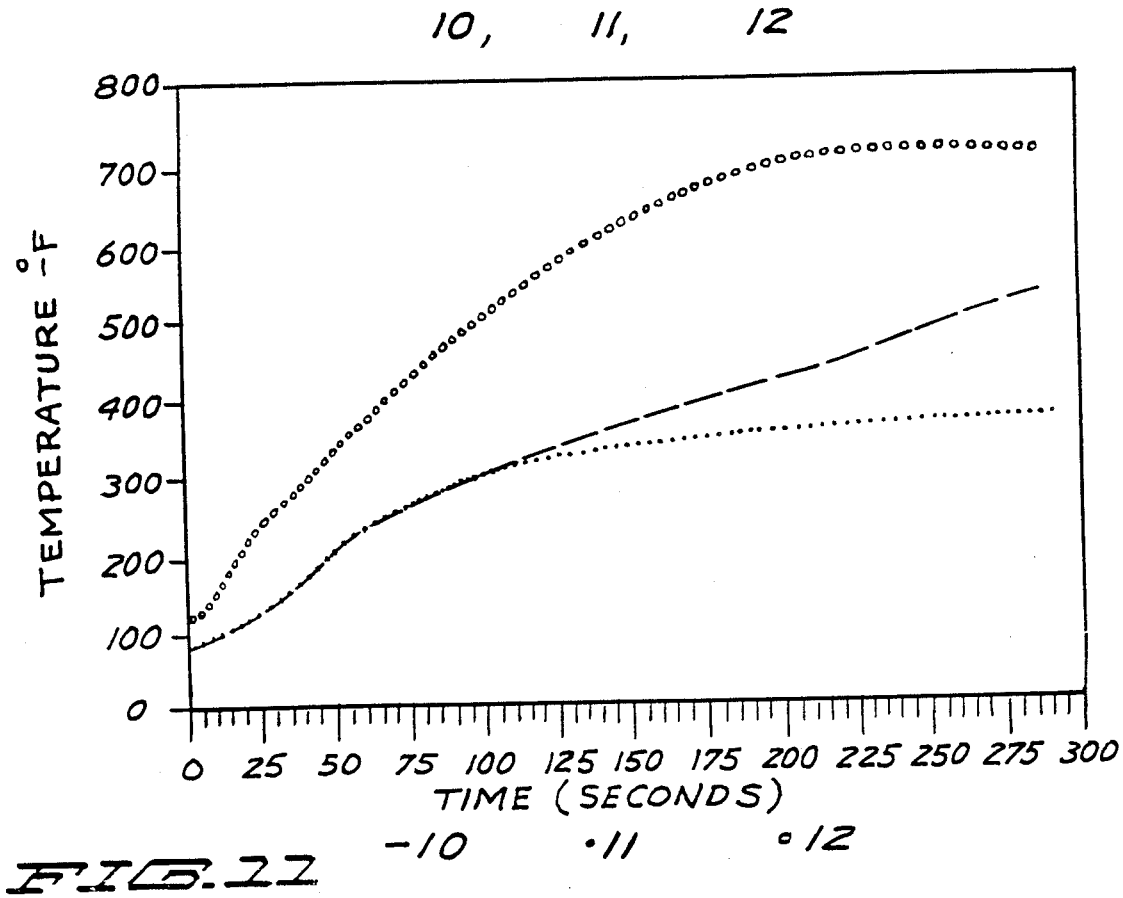

100 grams of glauconite-Greensand (available from Zook and Ranck, Gap, Pa.) was treated by saturating in 200 ml of a 0.36N ferrous ammonium sulfate (pH 3.44, M.W. 392.15) solution. The glauconite was removed after 3 hours, washed to a neutral pH, filtered and dried at 100° F. (38° C.). 30 grams of the treated glauconite was then placed in a 150 ml beaker without compaction and treated as previously described. The recorded and averaged temperature profile during the five minute microwave exposure is shown in FIG. 11 as line 10.

EXAMPLE 11

100 grams of glauconite-Greensand (available from Zook and Ranck, Gap, Pa.) was treated by saturating in 200 ml of a 0.36N ammonium chloride (pH 4.9, M.W. 53.49) solution. The glauconite was removed after 3 hours, washed to a neutral pH, filtered and dried at 100° F. (38° C.). 30 grams of the treated glauconite was then placed in a 150 ml beaker without compaction and treated as previously described. The recorded and averaged temperature profile during the five minute microwave exposure is shown in FIG. 11 as line 11.

EXAMPLE 12

100 grams of glauconite-Greensand (available from Zook and Ranck, Gap, Pa.) was treated by saturating in 200 ml of a 0.36N lithium hydroxide (pH 10.7, M.W. 42.0) solution. The glauconite was removed after 3 hours, washed to a neutral pH, filtered and dried at 100° F. (38° C.). 30 grams of the treated glauconite was then placed in a 150 ml beaker without compaction and treated as previously described. The recorded and averaged temperature profile during the five minute microwave exposure is shown in FIG. 11 as line 12.

EXAMPLE 13

100 grams of phlogopite mica-200HK, a super delaminated fine mica (available from Suzorite Mica Products, Hunt Valley, Md.) was treated by slaking in 200 ml of a 0.36N ferric chloride (pH 1.58, M.W. 162.21) solution. The mica was removed after 1 hour, washed to a neutral pH, filtered and dried at 100° F. (38° C.). 30 grams of the treated phlogopite mica was then placed in a 150 ml beaker without compaction and treated as previously described. The recorded and averaged temperature profile during the five minute microwave exposure is shown in FIG. 12 as line 13.

EXAMPLE 14

100 grams of phlogopite mica-200HK (available from Suzorite Mica Products, Hunt Valley, Md.) was treated by slaking in 200 ml of a 0.36N magnesium chloride (pH 9.34, M.W. 203.31) solution. The mica was removed after 1 hour, washed to a neutral pH, filtered and dried at 100° F. (38° C.). 30 grams of the treated phlogopite mica was then placed in a 150 ml beaker without compaction and treated as previously described. The recorded and averaged temperature profile during the five minute microwave exposure is shown in FIG. 12 as line 14.

EXAMPLE 15

100 grams of phlogopite mica-200HK (available from Suzorite Mica Products, Hunt Valley, Md.) was treated by slaking in 200 ml of a 0.36N sodium chromate (pH 9.35, M.W. 234.00) solution. The mica was removed after 1 hour, washed to a neutral pH, filtered and dried at 100° F. (38° C.). 30 grams of the treated phlogopite mica was then placed in a 150 ml beaker without compaction and treated as previously described. The recorded and averaged temperature profile during the five minute microwave exposure is shown in FIG. 12 as line 15.

EXAMPLE 16

20 grams of Zeolite LZ-Y72, an L type zeolite (synthetic) (available from Alfa Products, Danvers, Mass.) was treated by soaking in 50 ml of a 0.36N sodium borate (pH 9.34, M.W. 381.37) solution. The synthetic zeolite was removed after 1 hour, washed to a neutral pH, filtered and dried at 100° F. (38° C.). 20 grams of the treated zeolite was then placed in a 150 ml beaker without compaction and treated as previously described. The recorded and averaged temperature profile during the five minute microwave exposure is shown in FIG. 13 as line 16.

EXAMPLE 17

20 grams of Zeolite LZ-Y72, an L type zeolite (synthetic) (available from Alfa Products, Danvers, Mass.) was treated by soaking in 50 ml of a 0.36N cobalt chloride (pH 4.69, M.W. 237.93) solution. The synthetic zeolite was removed after 1 hour, washed to a neutral pH, filtered and dried at 100° F. (38° C.). 20 grams of the treated zeolite was then placed in a 150 ml beaker without compaction and treated as previously described. The recorded and averaged temperature profile during the five minute microwave exposure is shown in FIG. 13 as line 17.

EXAMPLE 18

20 grams of Zeolite LZ-Y72, an L type zeolite (synthetic) (available from Alfa Products, Danvers, Mass.) was treated by soaking in 50 ml of a 0.36N lithium hypochlorite (pH 10.69, M.W. 58.0) solution. The synthetic zeolite was removed after 1 hour, washed to a neutral pH, filtered and dried at 100° F. (38° C.). 20 grams of the treated zeolite was then placed in a 150 ml beaker without compaction and treated as previously described. The recorded and averaged temperature profile during the five minute microwave exposure is shown in FIG. 13 as line 18.

EXAMPLES 19–31

The dry ingredients were blended in the ratios indicated in Tables 1–3 for each example. The activated amphoteric materials were prepared by the methods described in Examples 1–18 according to the particular activation treatment required prior to formulation and dried to 2–5% moisture content. All prepared heating structures were in a 6 inch×6 inch standard format as detailed below with uniform thickness unless otherwise noted. The dry mix upon hydration was developed into a plastic mass and formed into 6 inch×6 inch×0.055–0.060 inch thick sheets containing a F non-woven fiberglass matt (Elk Corporation, Ennis, Tex.) for internal support and dried for 3 hours at 150° F. (65.6° C.). The heating structures exhibited minimal shrinkage, cracking or warpage. The structures were measured for heating performance in a microwave field as previously described. The recorded and averaged temperature profile of the heating structures are shown in FIGS. 14 through 18 as described in the following examples. The sources for the materials are as follows: sodium metasilicate pentahydrate—PQ Corporation, Valley Forge, Pa., calcium sulfate hemihydrate—U.S. Gypsum Company, Chicago, Ill.; bentonite—(NL Baroid western standard 200 mesh)—NL Baroid, Houston, Tex., Hectorite (Hectalite 200)—American Colloid Company, Skokie, Ill.; Tennessee Clay #6—Kentucky-Tennessee Clay Company, Mayfield, Ky.; crude vermiculite micron grade—Strong-Lite Products, Pine Bluff, Ariz.; phlogopite mica 200S —Suzorite Mica Products, Hunt Valley, Md.; Muscovite mica 200P—U.S. Gypsum Company, Chicago, Ill.; bentonite GK129 (southern bentonite)—Georgia Kaolin, Union, N.J.; Glauconite—Zook and Ranck, Gap, Pa.

TABLE 1

Examples 19–23 Formulations

| INGREDIENTS | EXAMPLE 19 | 20 | 21 | 22 | 23 |
|---|---|---|---|---|---|
| sodium metasilicate | 6* | 6 | 6 | 6 | 6 |
| calcium sulfate | 15 | 15 | 15 | 15 | 15 |
| bentonite | 50 | 50 | 50 | 50 | 50 |
| hectorite | 20 | 20 | 20 | 20 | 20 |
| Tennessee Clay #6 | 30 | 30 | 30 | 30 | 30 |
| Vermiculite | 0 | 37 | 37 | 52 | 52 |
| Mica | 52 | 15 | 52 | 15 | 15 |
| metal salt | 7.5 | 0 | 7.5 | 7.5 | 0 |
| water | 70 | 70 | 70 | 70 | 70 |

*units are in grams.

TABLE 2

Examples 24–27 Formulations

| INGREDIENTS | EXAMPLE 24 | 25 | 26 | 27 |
|---|---|---|---|---|
| sodium metasilicate | 6* | 6 | 6 | 6 |
| calcium sulfate | 15 | 15 | 15 | 15 |
| bentonite | 50 | 50 | 50 | 50 |
| hectorite | 20 | 20 | 20 | 20 |
| Tennessee Clay #6 | 30 | 30 | 30 | 30 |
| Vermiculite | 37 | 37 | 37 | 37 |
| Mica | 15 | 15 | 15 | 15 |
| water | 70 | 70 | 70 | 70 |

*units are in grams.

TABLE 3

Examples 28–31 Formulations

| INGREDIENTS | EXAMPLE 28 | 29 | 30 | 31 |
|---|---|---|---|---|
| sodium metasilicate | 5* | 6 | 6 | 6 |
| calcium sulfate | 30 | 30 | 30 | 30 |
| bentonite | 50 | 50 | 50 | 50 |
| Tennessee Clay #6 | 0 | 35 | 35 | 35 |
| Vermiculite | 12.5 | 10 | 10 | 10 |
| Glauconite | 12.5 | 0 | 0 | 0 |
| metal salt | 0 | 7.5 | 7.5 | 7.5 |
| silica flour | 15 | 0 | 0 | 0 |
| water | 70 | 70 | 70 | 70 |

*units are in grams.

EXAMPLE 19

The mica was a muscovite type-200P supplied by U.S. Gypsum Company and the metal salt was sodium chloride. The recorded and averaged temperature during the five minute microwave exposure is shown in FIG. 14 as line 19.

EXAMPLE 20

The mica was a muscovite type-200P obtained from U.S. Gypsum Company. The crude vermiculite micron grade was treated with 0.36N NaOH (1:2 parts w/v) for 1 hour and dried prior to formulation. The recorded and averaged temperature during the five minute microwave exposure is shown in FIG. 14 as line 20.

EXAMPLE 21

The mica was a phlogopite-200S obtained from Suzorite Mica Products. The metal salt was sodium chloride and the crude vermiculite was treated as outlined in Example 20. The recorded and averaged temperature during the five minute microwave exposure is shown in FIG. 14 as line 21.

EXAMPLE 22

The mica was a phlogopite-200S supplied by Suzorite Mica Products. The metal salt was sodium chloride and the crude vermiculite was treated as outlined in Example 20. The recorded and averaged temperature during the five minute microwave exposure is shown in FIG. 14 as line 22.

EXAMPLE 23

The mica was a phlogopite-200S (Suzorite Mica Products). The crude micron vermiculite was treated with 0.36N HCl containing 7.5 LiCl per 0.5 liter in a 1:2 parts w/v ratio for 1 hour, then washed and dried prior to formulation. The recorded and averaged temperature during the five minute microwave exposure is shown in FIG. 15 as line 23.

EXAMPLE 24

The mica was a phlogopite-200S (Suzorite Mica Products). The crude micron grade vermiculite and the western bentonite (NL Baroid) Standard 200 mesh were treated together using a 0.36N sodium sulfate solution in a 1:2 parts w/v ratio for 1 hour, then washed and dried prior to formulation. The recorded and averaged temperature during the five minute microwave exposure is shown in FIG. 15 as line 24.

EXAMPLE 25

Similar to Example 24 except that only the crude vermiculite was treated with a 0.36N ferrous ammonium sulfate solution in a ratio of 1:2 parts w/v for 1 hour, then washed and dried prior to formulation. The recorded and averaged temperature during the five minute microwave exposure is shown in FIG. 15 as line 25.

EXAMPLE 26

Similar to Example 24 except that only the crude vermiculite was treated with a 0.36N sodium citrate solution. The recorded and averaged temperature during the five minute microwave exposure is shown in FIG. 15 as line 26.

EXAMPLE 27

Figure 16:
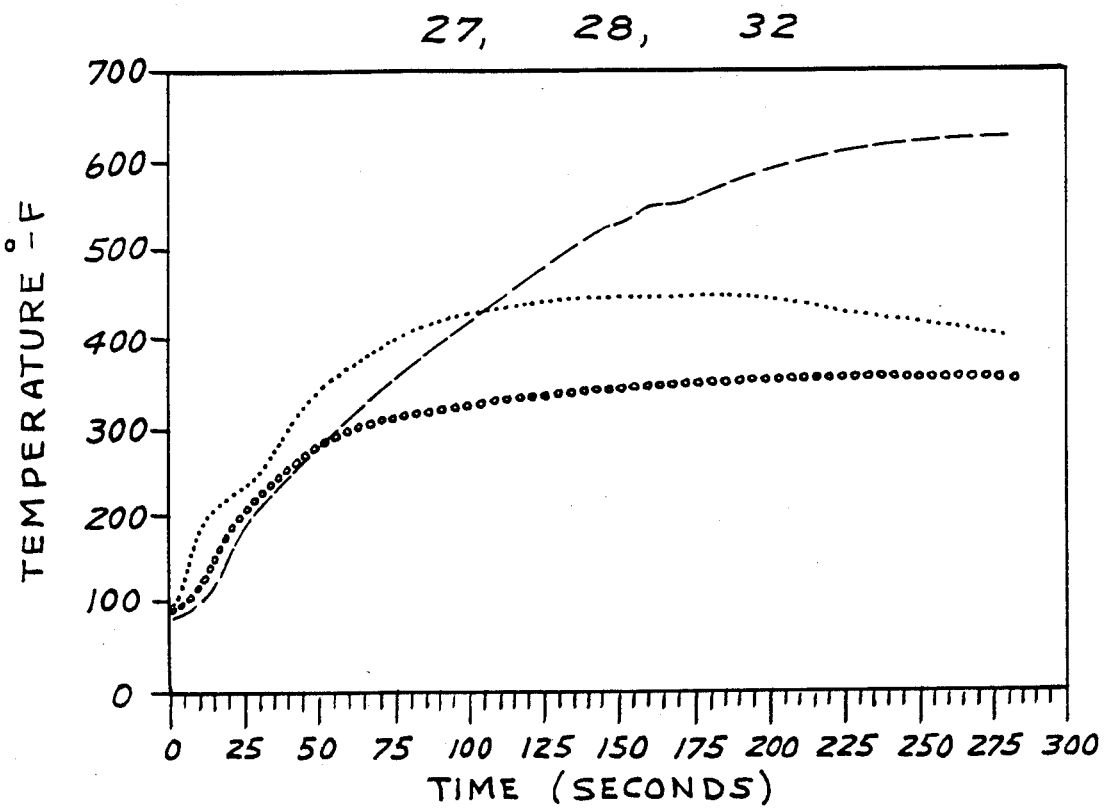

Similar to Example 24 with both the crude vermiculite and the western bentonite treated with a 0.36N sodium citrate solution. The recorded and averaged temperature during the five minute microwave exposure is shown in FIG. 16 as line 27.

EXAMPLE 28

The bentonite was a southern bentonite GK129 obtained from Georgia-Kaolin. The glauconite (obtained from Zook and Ranck) was previously treated with a 0.36N HCl solution containing 0.35 moles lithium chloride per liter in a 1:1 ratio w/v for 1 hour, then washed and dried prior to formulation. The silica flour-400 mesh was obtained from Ottawa Industrial Sand Company, Ottawa, Ill. The recorded and averaged temperature during the five minute microwave exposure is shown in FIG. 16 as line 28.

EXAMPLE 29

Figure 17:
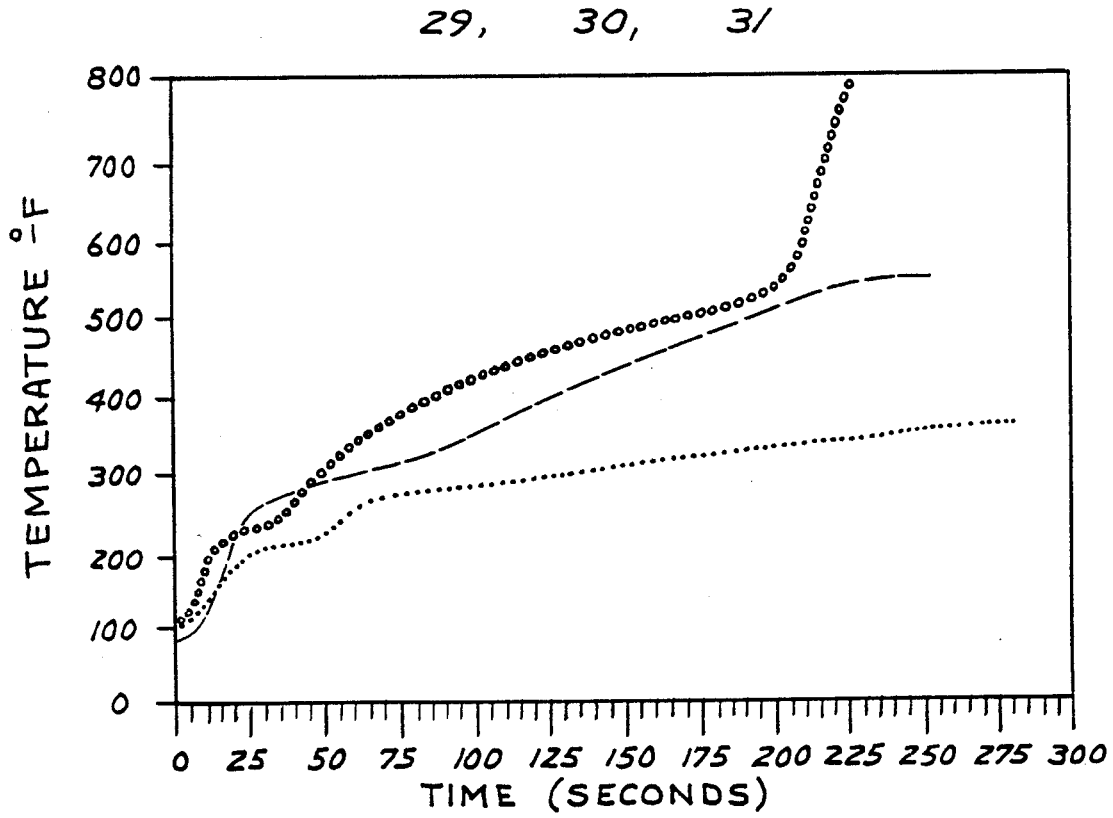

The bentonite was a southern bentonite-GK129 (Georgia-Kaolin). The metal salt was sodium chloride. The recorded and averaged temperature during the five minute microwave exposure is shown in FIG. 17 as line 29.

EXAMPLE 30

The bentonite was a southern bentonite-GK129 (Georgia-Kaolin). The titanium dioxide (Rutile) was obtained from Pfaltz and Bauer, Waterbury, Conn. The recorded and averaged temperature during the five minute microwave exposure is shown in FIG. 17 as line 30.

EXAMPLE 31

The bentonite was a southern bentonite-GK129 (Georgia-Kaolin). The metal salt is lithium chloride and a ground exfolliated vermiculite was used in place of the crude micron grade vermiculite. The recorded and averaged temperature during the five minute microwave exposure is shown in FIG. 17 as line 31.

EXAMPLE 32

Five grams of sodium metasilicate pentahydrate, 15 grams of calcium sulfate hemihydrate, 15 grams of Tennessee Clay #6, 20 grams of Hectalite 200, 50 grams of western NL Baroid standard 200 mesh bentonite, 41 grams saponite (available from Clay Minerals Society, Source Clay Minerals Repository, Dept. of Geology, University of Missouri, Columbia, Mo.) were dry mixed to a uniform consistency. Based on the cation exchange capability (C.E.) of each of the amphoteric materials determined at saturation at an optimum pH of 9.0 it was determined that 34.5 mg Na ion/gram of material was required to satisfy the C.E.C. (1% metal salt). The above dry mix was hydrated with 70 ml of a 0.083N sodium citrate solution (pH 9.01, M.W. 294.10) and mixed to a uniform plastic mass. The mix was then treated as detailed for Examples 19–31. The recorded and averaged temperature profile of the heating structure is shown in FIG. 16 as line 32.

EXAMPLE 33

Figure 18:
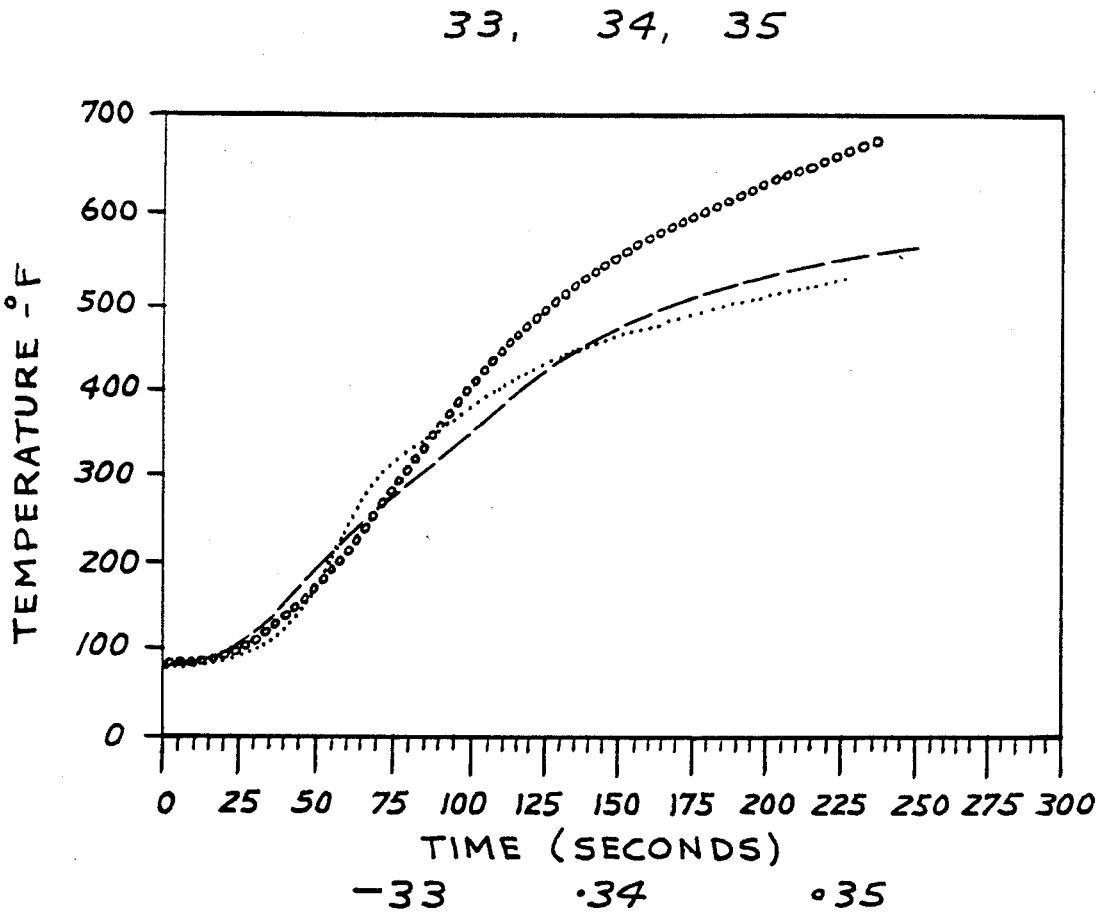

Crude vermiculite micron grade was steeped in a 0.36N NaOH solution (0.0288 g NaOH/g vermiculite) for several hours, filtered, washed to a neutral pH and dried at 150° F. (65.6° C.). The treated crude vermiculite was then mixed in equal parts by weight with a western bentoniteSPV200 (American Colloid Company, Skokie, Ill.). The active powder blend was then incorporated into a Sylgard silicone polymer matrix at a 40% by weight level and prepared into a 6 inch square x 0.070 inch thick flexible heating structure. The heating structure was measured for heating performance in the microwave field as previously detailed with a 500 gram water load in parallel. The recorded and averaged temperature profile of the heating structure is shown in FIG. 18 as line 33.

EXAMPLE 34

As Example 33 but at a 30% active blend level in the silicone polymer matrix and at 0.050 inches in thickness. The heating profile is shown in FIG. 18 as line 34.

EXAMPLE 35

As Example 33 but only using the treated crude vermiculite at the 22.5% level of incorporation into the silicone matrix for the active ingredient. The heating structure thickness was 0.055 inches. The heating performance is shown in FIG. 18 as line 35.

What is claimed is:

1. An article for use as a microwave heating susceptor in a microwave radiation field which article will absorb microwave radiation to produce heat and to raise the temperature of the article, comprising:

a microwave absorptive body, said body fabricated from a ceramic composition comprising:

(a) a binder for a ceramic material, (b) a ceramic susceptor material which absorbs microwave energy and having a residual lattice charge, and (c) a metal salt temperature profile moderator, and wherein the ceramic composition is unvitrified.

2. The article of claim 1 wherein the binder comprises about 2% to 99.9% by weight of the composition and wherein the ceramic susceptor material comprises about 0.1% to 98% of the composition, and wherein said body having a thickness ranging from about 0.3 to 8 mm.

3. The article of claim 1 wherein the ceramic susceptor material is selected from the group consisting of vermiculite, glauconite, Bentonite, zeolites, phlogopite mica, biotite mica, Hectorite, Chlorite, Illite, Attapulgite, Saponite, Sepiolite, ferruginous smectite, kaolinites, Halloysites, and mixtures thereof and wherein the metal salt temperature profile moderator comprises about 0.1% to 10% of the ceramic composition.

4. The article of claim 3 wherein the binder is selected from the group consisting of calcium sulphate, cements, calcite, silica fiber, whether amorphorus or crystalline, dolomite, aragonite, feldspar, pulverized polyamide fibers, colloidal silicas, fumed silicas, fiberglass, wood pulp, cotton fibers, thermoplastic resins and thermosetting resins.

5. The article of claim 4 wherein the ceramic susceptor material is selected from the group consisting of vermiculite, bentonite, hectorite, saponite, glauconites, micas, illite and mixtures thereof and wherein the temperature profile moderator is an accelerator.

6. The article of claim 1 wherein the ceramic susceptor material is a vermiculite.

7. The article of claim 1, 2, 3 or 4 wherein the binder is a thermoplastic resin.

8. The article of claim 1, 2, 3 or 4 wherein the ceramic composition comprises about 0.1% to 6% of the metal salt temperature profile moderator.

9. The article of claim 1, 2, 3 or 8 wherein the body is in sheet form.

10. The article of claim 1, 2, 3, 4 or 5 wherein the body additionally comprises a hydro or oleophobic sealant layer.

11. The article of claim 1, 2, 3, 4 or 5 wherein the body is fabricated from a compressed ceramic composition.

12. The article of claim 1, 2, 3, 9, or 10 wherein the body additionally comprises an underlying microwave shield layer.

13. The article of claim 1, 2, 3 or 4 wherein the body is in the form of a tray.

* * * * *